US011185136B2

(12) United States Patent
Gupta et al.

(10) Patent No.: US 11,185,136 B2
(45) Date of Patent: Nov. 30, 2021

(54) CLASP FOR CONNECTING A VARIETY OF ITEMS

(71) Applicant: Bihura LLC, Pleasanton, CA (US)

(72) Inventors: Priyanki Lakshmichander Gupta, Palo Alto, CA (US); Shalini Varshney, Pleasanton, CA (US)

(73) Assignee: BIHURA LLC, Pleasanton, CA (US)

( * ) Notice: Subject to any disclaimer, the term of this patent is extended or adjusted under 35 U.S.C. 154(b) by 89 days.

(21) Appl. No.: 16/243,898

(22) Filed: Jan. 9, 2019

(65) Prior Publication Data

US 2020/0214403 A1 Jul. 9, 2020

(51) Int. Cl.
*A44C 5/20* (2006.01)

(52) U.S. Cl.
CPC ..... *A44C 5/209* (2013.01)

(58) Field of Classification Search
CPC ..... A44C 5/209; A44C 5/2071; A44C 5/2057; Y10T 24/45534; Y10T 24/3904; Y10T 24/45801; Y10T 70/8703; A44B 15/00; A47G 29/10
See application file for complete search history.

(56) References Cited

U.S. PATENT DOCUMENTS

| | | | | |
|---|---|---|---|---|
| 1,829,232 | A * | 10/1931 | Morehouse | A44B 15/00 24/576.1 |
| 2,051,591 | A | 8/1936 | Brogan | |
| 3,379,041 | A * | 4/1968 | Hanna | A45C 11/323 70/456 R |
| 3,513,510 | A * | 5/1970 | Copes | A44B 11/2515 24/323 |
| 3,597,950 | A * | 8/1971 | Elsenheimer | A45C 11/323 70/456 B |
| 3,983,716 | A | 10/1976 | Kuhn | |
| 5,075,936 | A | 12/1991 | Glaser | |
| 5,653,009 | A | 8/1997 | Kassardjian | |
| 2005/0199008 | A1* | 9/2005 | Boland | A44B 15/00 63/37 |
| 2006/0021381 | A1 | 2/2006 | Richardson | |

OTHER PUBLICATIONS

PCT International Search Report and Written Opinion from PCT Application Serial No. PCT/US2019/062251 dated Jan. 17, 2020.

* cited by examiner

*Primary Examiner* — Robert Sandy
*Assistant Examiner* — Rowland Do
(74) *Attorney, Agent, or Firm* — Hogan Lovells US LLP

(57) ABSTRACT

A clasp with a mechanism to lock one or more keys is provided. The key can be affixed to an end of an ornamental item such as a chain, pendant, or charm. The clasp can include an inlet port for inserting a key and one or more channels for guiding the key towards one or more locking pockets. A compressible material can resist movement of the key along the channel and can prevent unwanted removal of the key at the locking pocket.

18 Claims, 12 Drawing Sheets

CLASP FOR CONNECTING A VARIETY OF ITEMS

BACKGROUND

People of many cultures enjoy wearing complex and interconnected jewelry. For example, a person might wear a single piece of jewelry comprising multiple chains, pendants, and clasps. Such jewelry can be worn around the head, neck, arms, hands, waist, etc. A clasp can be used to connect two or more jewelry pieces. Clasps are typically utilized to facilitate wrapping jewelry around a neck, wrist, ankle, etc. Many clasps such as a spring ring clasp, lobster clasp, barrel clasp, and toggle clasp utilize a locking mechanism to further secure the jewelry elements and prevent unwanted disconnection.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Devices in accordance with various embodiments of the present disclosure may overcome one or more of deficiencies experienced in conventional clasps and other mechanisms or devices for mechanically interlocking multiple pieces. For example, many previous clasps only have a single connection point, are large and heavy, are difficult to use, or are not secure.

The locking mechanism in a clasp herein disclosed benefits from being simple, secure, lightweight, and easy to manipulate. Traditionally, clasps which have secure locking mechanisms are large, heavy, and mechanically complex. Similarly, traditional clasps that are small and lightweight do not have a secure locking mechanism or can only connect a single piece of jewelry.

Accordingly, some embodiments of the present invention include a clasp for locking at least one key. The clasp can be any mechanical device for connecting items. The clasp can include an inlet port for receiving a key of an item. The clasp can have a locking mechanism whereby the key of the item can be secured to the clasp. The clasp can have a channel connecting the inlet port to a locking pocket of the locking mechanism. A person can then insert the head of the key (e.g., a sphere at the end of the key) into the inlet port and move the key along the channel with the head inside the channel until the head of the key is engaged at the locking pocket. In order to control the movement of the head of the key, a compressible material can be inside the clasp. The key can compress the compressible material which will rebound the key and minimize unwanted movement. The compressible material can cause the movement through the channel to be controlled and smooth and can assist in locking the key at the locking pocket.

This type of clasp enables custom configuration and reuse of jewelry. In certain cultures, complex jewelry can be important for various celebrations and ceremonies. Buying different items for each of these can be very expensive, particularly when then will rarely be worn. This invention enables various combinations to be designed as needed using existing pieces, and enables a few expensive piece s to be purchases that can be incorporated into the various designs.

Figure 1A:
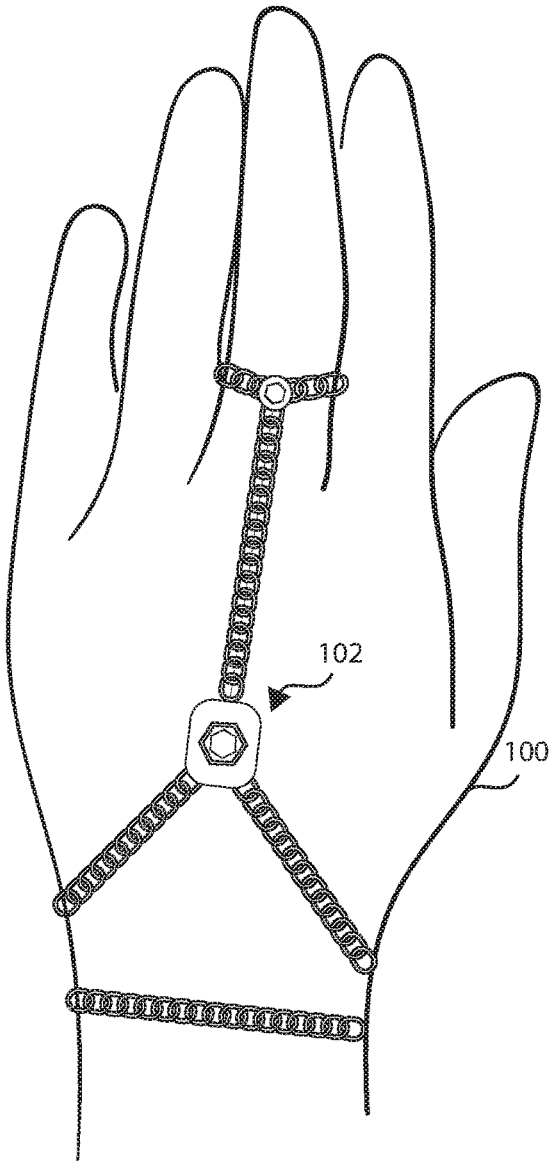
FIGS. 1A, 1B, and 1C illustrate example applications and implementations according to various embodiments.
Figure 1B:
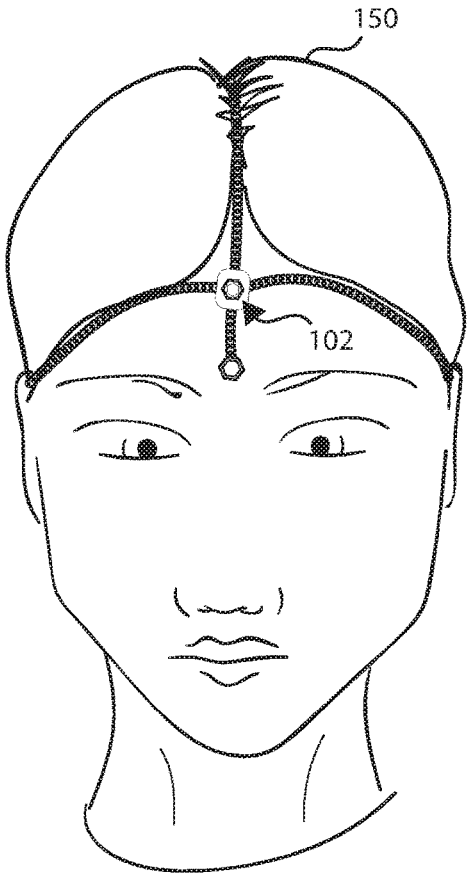
Figure 1C:
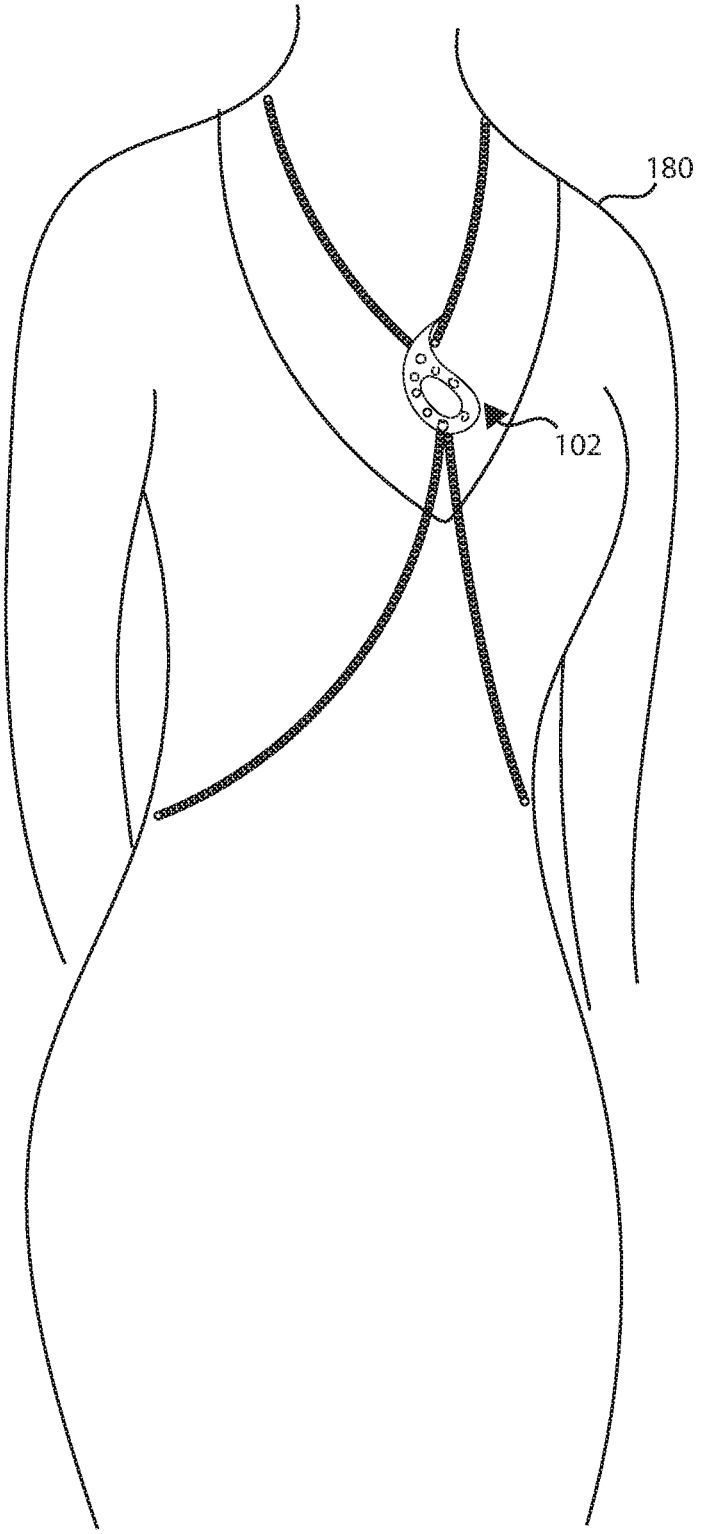

FIGS. 1A, 1B, and 1C illustrate example applications and implementations according to various embodiments. In various cultures and ceremonies, people enjoy wearing jewelry that is interconnected in various manners. For example, in FIG. 1A, clasp 102 connects three chains around the hand 100 of a wearer. People might enjoy also attaching pendants, charms, jewels, or other ornamental items to a single clasp. This technique of connecting multiple ornamental items via a single clasp is demonstrated in FIG. 1B wherein a person is using the clasp 102 to join three chains around her head with a fourth connection for a decorative piece. In FIG. 1C, a woman 180 can wear a chain around her neck and waist that connects across her chest using clasp 102. FIG. 1C demonstrates how clasp 102 can be large and decorative. Similarly, some people enjoy connecting ornamental items around their waist, wrist, neck, feet, etc.

Creating the depicted jewelry traditionally required a certain degree of artistic prowess. A person would have to have the knowledge, tools, and time to solder, weld, and manipulate components in the desired configuration. The clasp 102 as shown in FIGS. 1A, 1B, and 1C can be easily configured and reconfigured by someone without tools, training, or time. For example, a person can use the clasp 102 on their hand one day and then disconnect the chains and use the clasp 102 with a head ornament the next day. Instead of producing different jewelry items for every need, a manufacturer can produce components such as clasp 102 which can then be configured and reused by the end user.

The techniques described herein should not be limited to ornamental pieces such as jewelry. For example, the mechanical coupling of the clasp can be utilized for an electronic connection. For example, a battery pack could have multiple connection points for connecting and powering other components. The techniques described herein can also be applicable to toys. For example, a figurine might have a main body serving as the clasp and can have other parts such as arms, legs, and a head connect to the main body as described herein. Construction applications are also contemplated. For example, a platform can serve as the clasp and various posts or guard rails to build a scaffolding system. Therefore, it should be understood that the principles herein discussed are not limited to a certain application or embodiment.

Figure 2A:
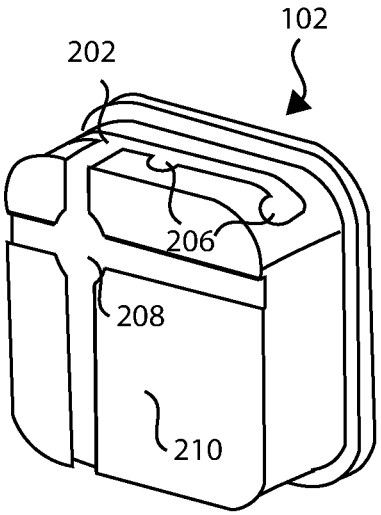
FIGS. 2A and 2B present views of a clasp according to various embodiments.
Figure 2B:
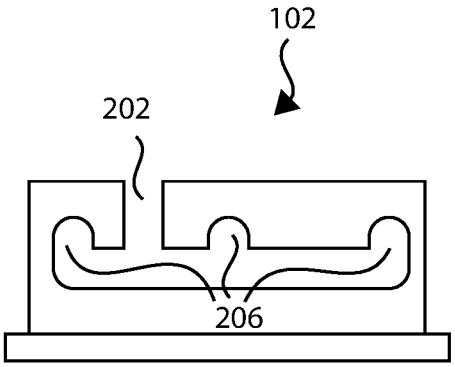

FIGS. 2A and 2B present views of a clasp 102 according to various embodiments. FIG. 2A illustrates a perspective view of the clasp 102, wherein the clasp 102 has one or more channels 202 connecting at least one inlet port 208 to one or more locking pockets 206. In some embodiments, the clasp can have a back 210 with an inlet port 208 opposite a front (hidden in FIG. 2A). The front can be outward facing and can have designs or gems attached. One or more perimeter sides can be on the top, left, right, and bottom of the clasp 102. It should be understood that "back," "front," "left," "right," "bottom," and "top" are labels of convenience in view of the figures and should not be limiting. Furthermore, it should be understood that clasp 102 can have fewer or more "sides" than depicted. For example, the clasp 102 can be a spheroid having substantially a single surface. The clasp 102 can be made of, but not limited to, a metallic material, an alloy, a plastic material, and any such material that is obvious to a person ordinary skilled in art.

In some embodiments, the inlet port 208 can be at the junction of multiple channels 202. A person can insert a key of a chain into the inlet port 208 can then drag the key along a channel 202 to a desired locking pocket 206. A person can then insert subsequent keys and drag them to other locking pockets 206 as desired. As shown in FIG. 2A, the locking pockets 206 can be on different a different sides of the clasp 102 than then inlet port 208, for example, a locking pocket 206 can be on a side that is perpendicular to the surface comprising the inlet port 208. When a person drags a key along a channel 202, the channel may guide the key around a corner such as the corner where the back 210 abuts the top side.

The inlet port 208 can be configured for receiving at least one key. The inlet port 208 can have a square shaped opening, a rectangle shaped opening, a circular shaped opening, an irregular shaped opening, a polygonal shaped opening, etc. The inlet port 208 can be specific to a shape of a key such that only certain keys will be able to fit in the inlet port 208.

A channel 202 on the clasp can follow various paths along the surface of the clasp 102. For example, the channel can 202 can form a linear path, a curved path, a path that makes a design, etc.

As shown in FIG. 2B, multiple locking pockets 206 can be present on a channel 202. When adding multiple ornamental items to the clasp 102 as shown in FIG. 2B, a person can move a first key to the locking pocket 206 on the right, then a second one in the middle locking pocket 206. To remove the keys in this example, the middle key must be removed followed by the key on the right. In some embodiments, the locking pockets 206 are visible on the surface of the clasp 102. For example, in FIG. 2B, the locking pockets 206 appear as enlarged openings of the channel 202. In some embodiments, the locking pocket 206 is not identifiable within the channel 202. In some embodiments, marking on the surface of the clasp 102 indicate where a locking pocket 206 is located along a channel 202.

Figure 3:
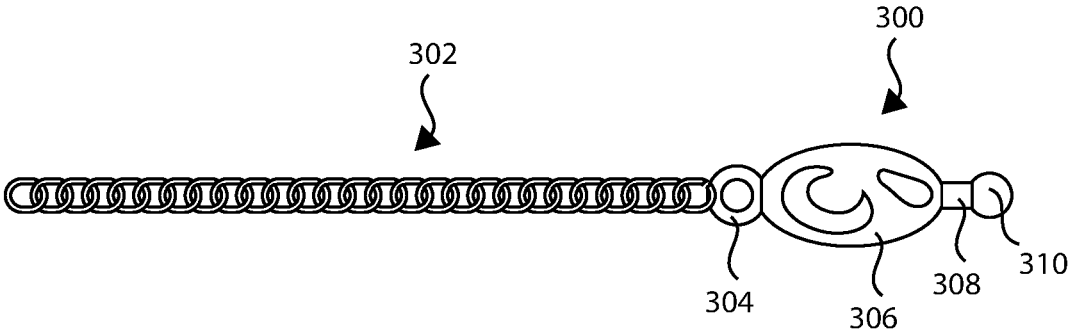
FIG. 3 illustrates an example ornamental chain attached to a key according to various embodiments.

FIG. 3 illustrates an example ornamental chain 302 attached to a key 300 according to some embodiments. The key 300 can be an intermediate member configured to connect an article with the clasp 102. The article can be, but not limited to, an ornament, a thread, a twine, a string, a chain (e.g., chain 302), a charm, and any other such article. In some embodiments, the key 300 is not an intermediate member, but serves functional or aesthetic purposes itself. For example, the key 300 can have a gem attached to it or can comprise a second key 300 for coupling two clasps 102 together. The key 300 can comprise a head 310, a neck 308, a main body 306, and rear 304. The key 300 can be made of a metallic material, an alloy, a plastic material, and any such metal. The key 300 need not be made of the same material as the chain 302.

The head 310 can be configured to be inwardly inserted into the at least one inlet port 208 and also configured for locking at the at least one locking pocket 206. The shape and size of the head 310 can vary according to the shape and size of the at least one inlet port 208 and channel 202 such that the head 310 can be successfully inserted inwardly into the at least one inlet port 208. The shape of the head 310 can have a square cross-section, a rectangular cross-section, a circular cross-section, an irregular cross-section, a polygonal cross-section, and any other cross-section. In some embodiments, the head is tapered on the sides to facilitate easy movement along the channel 202 of the clasp 102. For example, the head can be spherical, hemispherical, or oblong. The head 310 can be configured to prevent unwanted extraction of the key from the channel 202 or locking pocket 206. For example, the head can pass within the channel 202 from the inlet port 208 to the locking pocket 206, but cannot be removed at the channel 202 or the locking pocket 206. This can be accomplished by having a width of the head 310 be wider than an opening of the channel 202 at the surface of the clasp 102.

A neck 308 can connect the head 310 to the main body 306. The neck 308 can be configured to pass along an opening of the channel 202 at the surface of the clasp 102. In other words, while the key 300 travels along a channel, the head 310 can be within an interior of the clasp 102, the main body 306 can be exterior to the clasp 102 and the neck 308 can travel at an opening formed by the channel 202 at the surface of the clasp 102. The neck 308 can be cylindrical to facilitate movement through the channel 202. Furthermore, the neck 308 and the head 310 can be rounded so as to enable the key 300 to rotate and pivot even while locked at a locking pocket 206.

The main body 306 can constitute the major portion of the key 300 and can connect the head 310 and neck 308 with the rear end 304. The main body 306 may be spherical, cylindrical, cuboidal, or any other shape. The main body 306 can comprise of a company logo, an embossed numeric, a sticker and any such artistic work. The main body 306 can be configured to prevent entrance of the main body 306 into the channel 202 of the clasp 102. For example, the main body 306 can be wider than the neck 308 of the key 300 and an opening of the channel 202. In some embodiments, the main body 306 can comprise features designed for gripping the key 300 while moving it.

The rear end 304 can be configured to connect with the at least one article which includes, but not limited to, an ornament, a thread, twine, a string, a chain, a charm, and any such article. The connection of the rear end 304 with the at least one article can use permanent joint or a temporary joint. A permanent joint may include, but not limited to, a rivet joint or a soldered joint. A temporary joint may include, but not limited to, a nut-bolt joint or a hook joint. In some embodiments, the key 300 can be securely connected to the clasp 102 at a certain locking position whereas an article can be connected to the key 300 in a less secure manner (e.g., a hook). Such a configuration can ensure that the article is connected at a certain place at the clasp 102 but can allow certain pieces to be easily removed without disassembling the clasp 102 and keys 300.

FIGS. 4A-4F illustrate an example technique for connecting multiple items to a clasp 102. For example, in FIGS. 4A and 4B, a person can insert a key 300*a* of the item into an inlet port 208 of the clasp 102. Specifically, the head 310 of the key can be inserted into the inlet port 208 of the clasp 102. In these figures, the inlet port 208 is on the back of the clasp 102 but other configurations are contemplated. Furthermore, multiple inlet ports 208 can be used with the clasp 102.

Figure 4A:
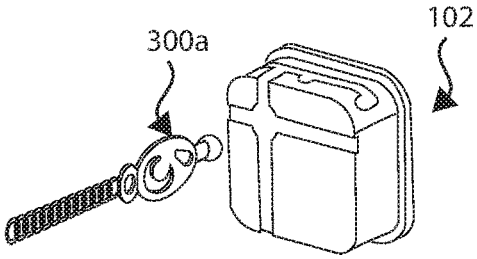
FIGS. 4A-4F illustrate an example technique for connecting multiple items to a clasp according to various embodiments.
Figure 4B:
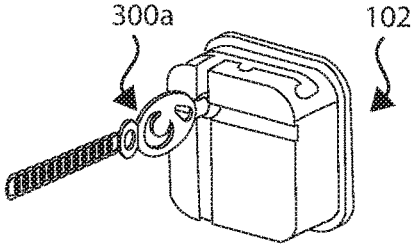
Figure 4C:
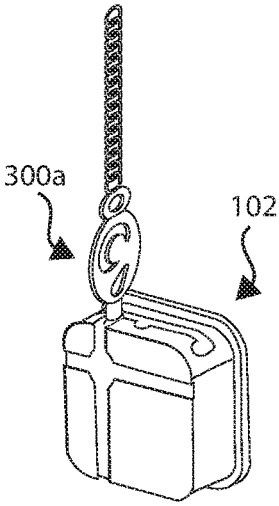

After insertion of the key 300*a*, the key 300*a* can be dragged along the channel 202 as depicted in FIGS. 4B and 4C. In the clasp 102 shown, the channel 202 branches at a "T" whereby the key 300*a* can then be dragged to one of many different locking pockets 206. In the figures shown, the key 300*a* is dragged along a channel 202 that goes from one plane (e.g., the back) to another plane (e.g., the top side). The intersection of the two planes can be rounded to facilitate easy movement of the key between planes. In some embodiments, the intersection is abrupt (e.g., a right angle).

Figure 4D:
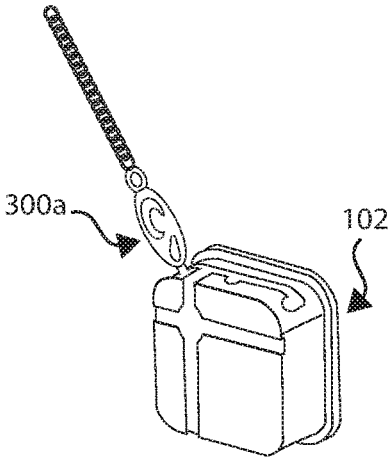

The key 300*a* can then be dragged from the channel 202 to a locking pocket 206 as depicted in FIGS. 4C and 4D. When in the locking pocket 206, the movement of the key 300*a* can be restrained. In some embodiments, the locking pocket 206 hinders translation (e.g., sliding) of the head 310 of the key 300*a* while the head 310 can still be rotated about one more axes. In some embodiments, the main body 306 of the key prevents extreme rotations of the key 300*a* as it will press against a surface of the clasp 102.

Figure 4E:
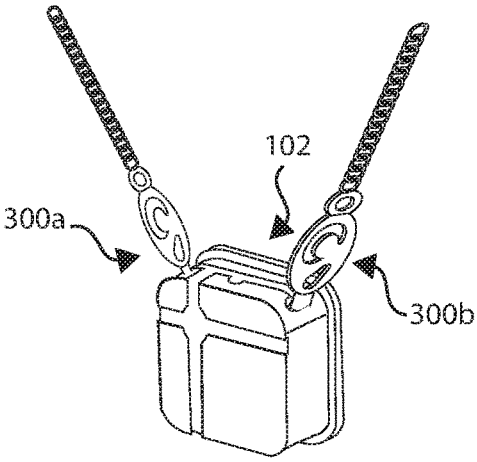
Figure 4F:
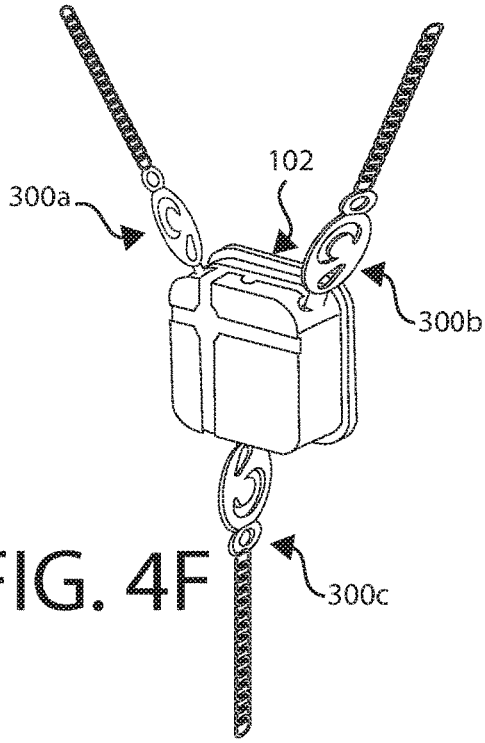

In FIGS. 4E and 4F, multiple keys 300 are shown connected to a single clasp 102. For example, key 300*a* is connected on one top corner, key 300*b* is connected to another top corner, while key 300*c* is connected to a bottom side. It should be understood that the clasp 102 can have multiple keys 300 locked on multiple sides and the keys 300 need not be coplanar when locked. For example clasp 102 can have a locking pocket 206 on the front of the clasp 102 (e.g., the side opposite the back where the inlet port 208 is depicted). Clasp can also have a locking pocket 206 on the same side as the inlet port 208.

The simplicity of the locking pocket 206 enables the clasp 102 and the key 300 to be light weight. This allows the clasp 102 to connect multiple keys 300 at one time. Furthermore, this enables the clasp 102 to survive more wear and tear in comparison to more complex solutions.

Figure 5:
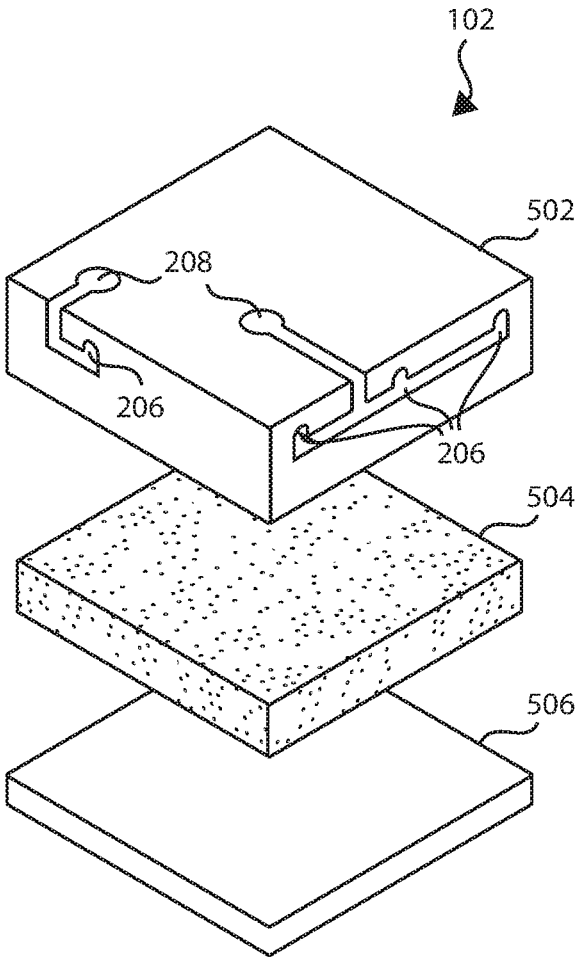
FIG. 5 illustrates an exploded view of a clasp according to various embodiments.

FIG. 5 shows an example exploded view of the clasp 102. For example, a shell 502 can surround a compressible material 504 affixed to a decorative plate 506. In order to create the clasp 102, a manufacturer can glue the compressible material 504 to the decorative plate 506. The manufacturer can drill (e.g., using a command and control precision device) inlet ports 208, locking pockets 206, and the channels that connect them. The shell 502 can have a hollow interior to fit around the compressible material 504. The shell 502 can then be soldered to the decorative plate 506 such that the compressible material 504 is surrounded by the shell 502. It should be understood that the compressible material 504 need not entirely fill the shell 502. For example, there can be a gap between the compressible material 504 and the shell 502 which can enable the key 300 to easily enter the inlet ports 208. The compressible material 504 can extend through the channels disposed on the sides of the clasp 102.

The compressible material 504 can be a polymer. In some embodiments, the compressible material 504 is formed before being joined with other components of the clasp 102. In some embodiments, the compressible material 504 is poured or otherwise cured within the clasp 102. In some embodiments, a surface of the compressible material 504 can be hardened, coated, decorated, or otherwise used in such a way that obviates the need for the decorative plate 506.

FIGS. 6A-6D illustrate an example technique for moving a key along a channel to a locking pocket 206 according to various embodiments. FIGS. 6A-6D present a side view of the clasp such that the decorative plate 506 is shown towards the bottom of the figures and the shell 502 is on the top section of the figures. The compressible material 504 is largely obscured, though can be seen through the channel 202. The channel is the region of the shell 502 that connects the locking pockets 206 to the inlet port 208.

Figure 6A:
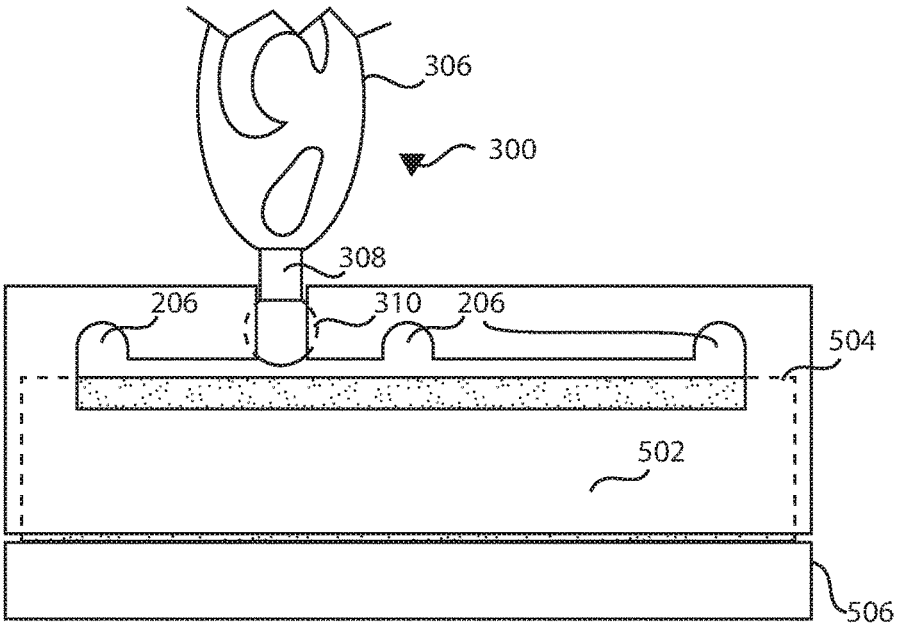
FIGS. 6A-6D illustrate an example technique for connecting a key to a clasp according to various embodiments.
Figure 6B:
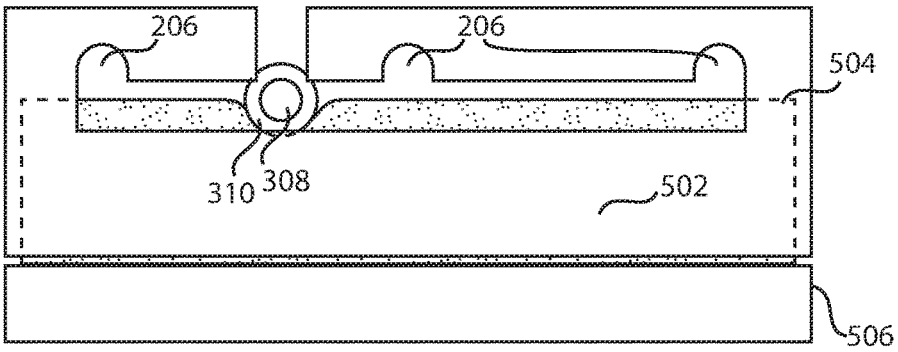
Figure 6C:
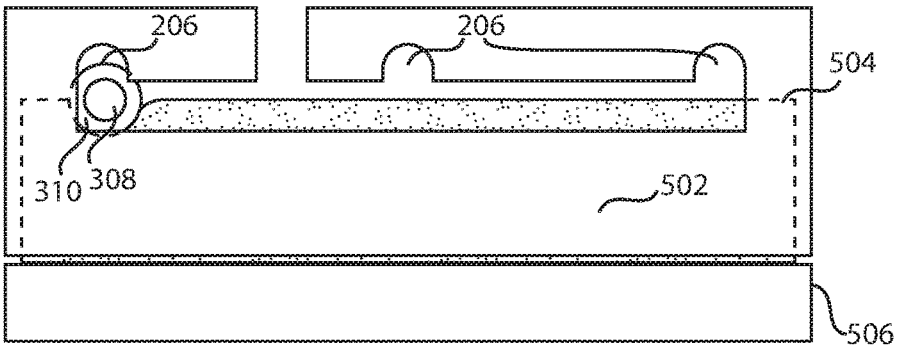

In FIG. 6A, the head 310 of the key 300 can be inserted into the clasp 102. This is similar to the action depicted in FIG. 4B. It should be noted that the compressible material 504 need not extend to the "top" (as shown in this figure) of the clasp 102. For example, the head 310 of the key 300 does not touch the compressible material 504 when inserted into the inlet port 208. This makes insertion relatively easy. The head 310 of the key 300 can then be dragged through the channel of the shell 502 to a "T" as shown in FIG. 6B (similar to the action shown in FIG. 4C). As the head 310 of the key 300 is dragged, it can go from one surface to another surface by going around a corner. The key 300 can thus be rotated around the corner such that it is generally perpendicular to the local surface. As the head 310 of the key 300 approaches the side channel (e.g., the channel connecting the locking pockets 206) it can contact the compressible material 504. In order to enter the side channel, the key 300 can be forced to compress the compressible material 504. In some embodiments, just the head 310 compresses the compressible material 504. Additionally or alternatively, the neck 308 of the key 300 can compress the compressible material 504.

The key 300 can then be dragged towards a locking pocket 206. Using the frame of reference of FIG. 6C, the key 300 can be dragged left while the compressible material 504 exerts an upward force on the head 310 and/or neck 308 of the key 300. While in the side channel, the opposing forces of the shell 502 and compressible material 504 can cause dragging to be difficult.

Figure 6D:
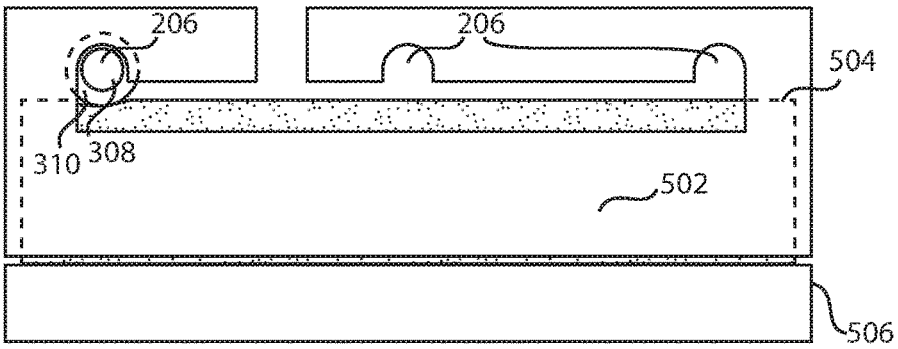

When the key 300 arrives at a locking pocket 206, the shell 502 can provide relief to the restoring force of the compressible material 504 as shown in FIG. 6D. The key 300 can then be pushed into the locking pocket 206 by the compressible material 504. In some embodiments, the key 300 has space within the locking pocket 206 to freely rotate and pivot. For example, in some embodiments the compressible material 504 does not extend into the locking pocket 206 or otherwise provides enough space for the key 300 to rest in the locking pocket 206 without compressing the compressible material 504. Alternatively or additionally, the compressible material 504 can continue to be compressed while the key 300 is in the locking pocket 206; this can help restrain rotational freedom of the key 300.

While in the locking pocket 206, the compressible material 504 prevents the unwanted removal of the key 300 from the clasp 102. In order to remove the key 300, a person must compress (or further compress) the compressible material 504 sufficiently so as to allow the key 300 to reenter the channel. In FIG. 6D, this would require the person to push down and then right on the key 300 and drag the key 300 sufficiently to navigate the channel to eventually reach the inlet port 208. In the unlikely event that the key 300 accidentally enters the channel, the resistance within the channel will be sufficient to arrest the key 300 until the user is able to reset the key 300 in the locking pocket 206.

Figure 7:
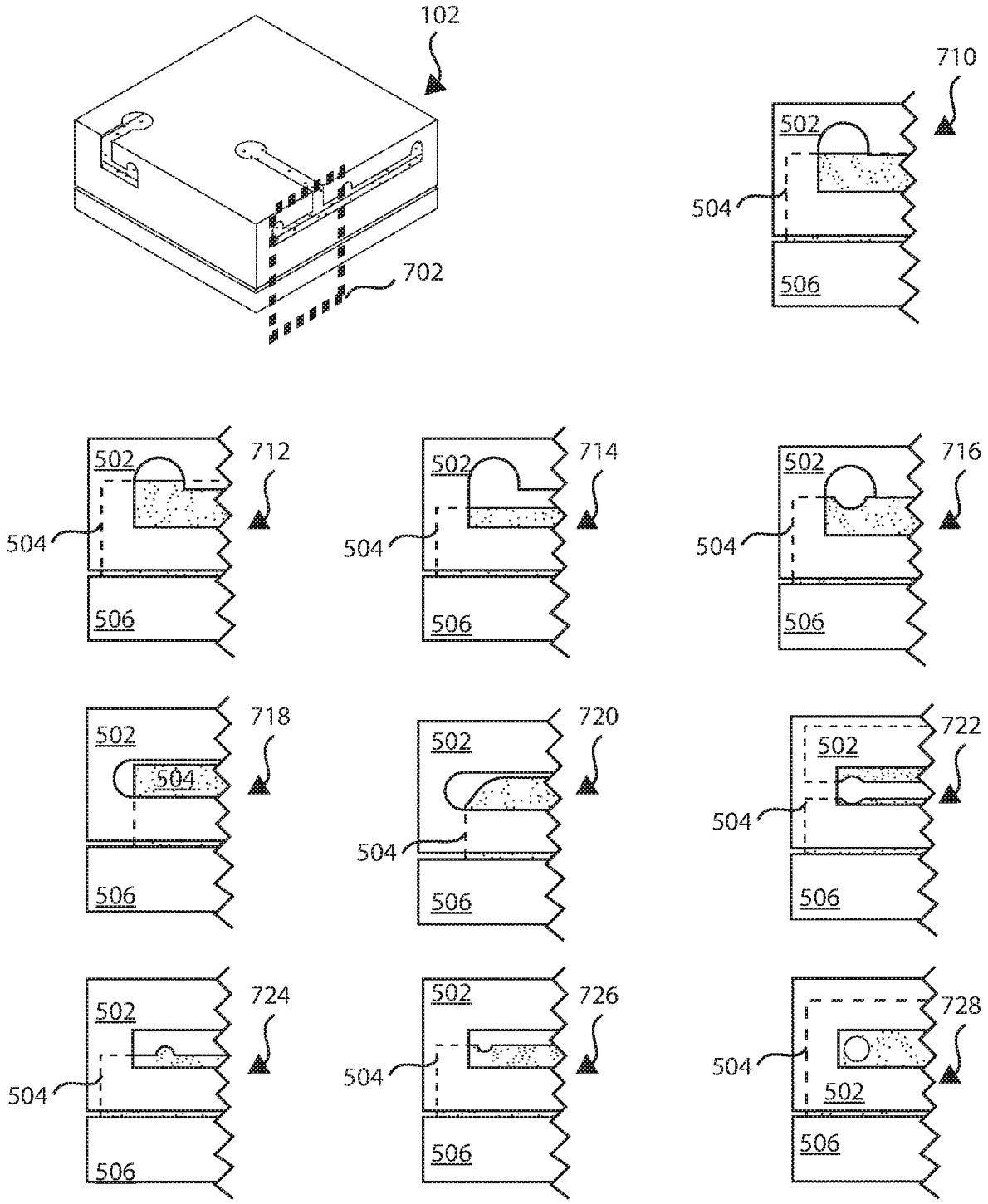
FIG. 7 illustrates example configurations of a locking pocket according to various embodiments.

FIG. 7 demonstrates example configurations of the locking mechanism for a clasp 102. The various configurations show different cuts in the shell 502 as well as different designs of the compressible material 504 which can be utilized according to various embodiments. View window 702 shows the perspective for these examples. It should be understood that a locking pocket 206 can be located in various places on the clasp 102 and should not be limited to the location(s) shown in the figures presented herewith. While certain features may be described according to certain examples, such features should not be deemed exclusive to such examples. Embodiments that are a combination of examples are contemplated. It should be understood that although two-dimensional representations of features are shown in FIG. 7, features can be three-dimensional. For example, a groove can be cut in the compressible material where the head 310 of the key 300 is expected to pass.

The compressible material 504 can vary in size and coverage. The more it extends to cover the channel, the more compression is required to move the key 300 through the channel. Additionally, the more the compressible material 504 extends into the locking pocket 206, the more compression is required to extract the key 300 from the pocket and rotation of the key is also restrained. In example, 710, the locking pocket 206 is a cutout of the shell 502 that extends beyond the compressible material 504. In some embodiments, the compressible material 504 can fully decompress when the key 300 is within the locking pocket 206. Further, in example 710, the compressible material 504 can cover the channel (or at least a region of the channel). In example 712, the compressible material 504 covers the channel and extends into the locking pocket 206. In this configuration, the compressible material 504 can minimize rotation of the key 300 which can be desirable in some embodiments. The compressible material 504 can further be extended so that it covers the locking pocket 206 entirely. This might make it difficult to return the key 300 to the channel as a large amount of compression would be required. In example 714, the compressible material 504 only partially covers the channel.

The compressible material 504 can have features that facilitate capture in the locking pocket 206. For example, in examples 716, 722, and 726 the compressible material 504 has a divot cut out for the key 300 to rest in. This divot can make it so that the compression of the compressible material 504 is less at the locking pocket 206.

In some embodiments, the locking pocket 206 is located in the same direction as the force applied to the key 300 when it is within the channel. For example, in examples 710, 712, 714, and 716 the compressible material 504 exerts a force "upward" (relative to the figure) on the key 300 and the locking pocket 206 is located upward of the channel thereby rebounding from the force as it enters the locking pocket 206. Other configurations are contemplated, for example examples 718 and 720 demonstrate the locking pocket 206 being along the path of the channel and perpendicular to the force generally applied by the compressible material 504. While a key inserted into the locking pocket 206 of example 718 may be difficult to remove, such a configuration may be advantageous in some embodiments where permanency is desired. Such permanency can be minimized by rounding the corner of the compressible material 504 as shown in example 720. The corner of the compressible material 504 can be "cut off" along various angles or shapes.

In some embodiments, the locking pocket 206 is not identifiable on the shell 502. For example, the compressible material 504 can include features to enable the key 300 to lock in place along a channel cut in the shell 502. For example, in examples 722, 724, 726, and 728, features of the compressible material 504 define features for locking the head 310 and/or neck 308 of the key 300. It should be understood that features in the compressible material 504 are not exclusive to features in the shell 502 and the various features can be combined as appropriate.

With example 722, there is a top compressible material and a bottom compressible material which each have a divot cut out to receive the key 300. Similarly, in example 726, a divot is cut out on a bottom compressible material 504. In example 724, the compressible material can have a feature that is near the locking location that retains the key 300 but does not hinder movement of the key 300 through the channel. For example, a bump can exist near the locking location. Multiple bumps can be used to further define a locking location (e.g., on the left and right).

In some embodiments, a feature can be cut away from the compressible material 504 as shown in example 728. For example, the compressible material can be placed a distance away from the channel to allow the key 300 to move along the channel rubbing against the compressible material 504 (e.g., the compressible material pushes outwards towards the surface of the shell 502). The compressible material 504 can have a cutout where the head 310 of the key 300 can rest when locked.

Figure 8A:
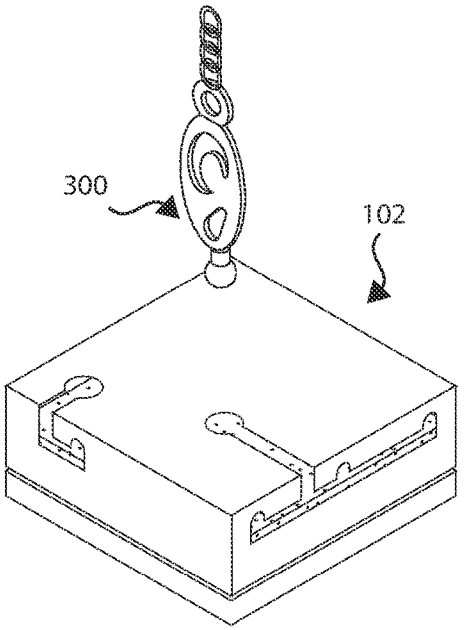
FIGS. 8A-8E illustrate an example technique for maneuvering a key into a locking pocket of a clasp according to various embodiments.
Figure 8B:
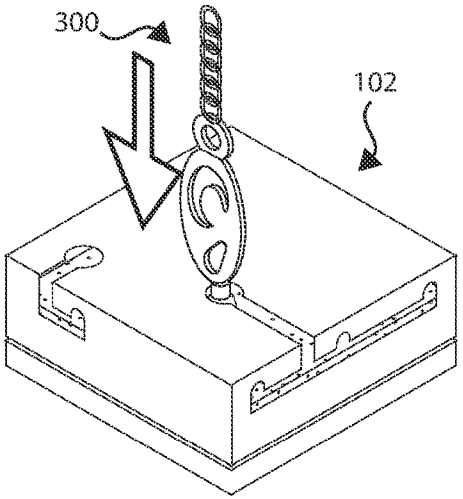
Figure 8C:
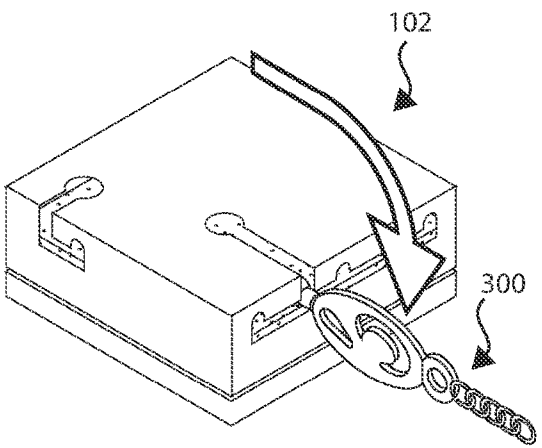
Figure 8D:
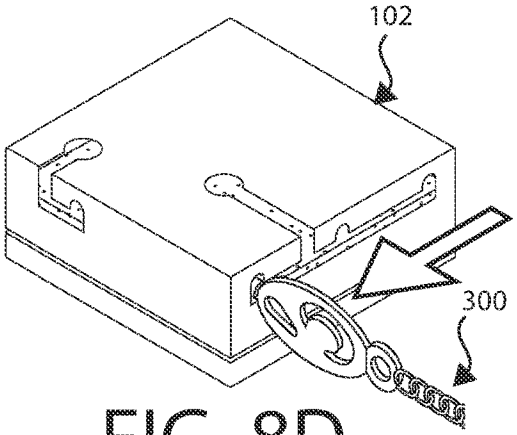
Figure 8E:
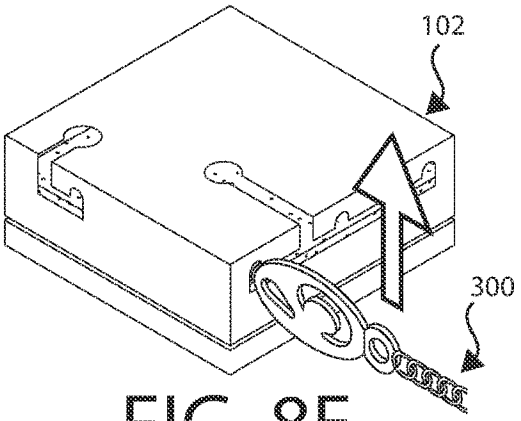

FIGS. 8A-8E show an example locking technique according to various embodiments. For example, a key 300 can be inserted into a clasp 102 (similar to FIGS. 6A and 4A) as shown in FIGS. 8A and 8B. The key 300 can then be slid along a channel and around a bend to a side surface of the clasp as shown in FIG. 8C (similar to FIGS. 4B, 4C, and 6B). In some embodiments, the movement shown in FIG. 8C is not impeded by the compressible material 504. For example, the compressible material 504 might not be close to a top surface of the clasp 102. The key 300 can then be dragged through the channel to a locking pocket as shown in FIG. 8D (similar to that shown in FIGS. 4D and 6C). The key 300 can then be pushed up into the locking pocket as shown in FIG. 8E (similar to FIG. 6D).

Figure 9A:
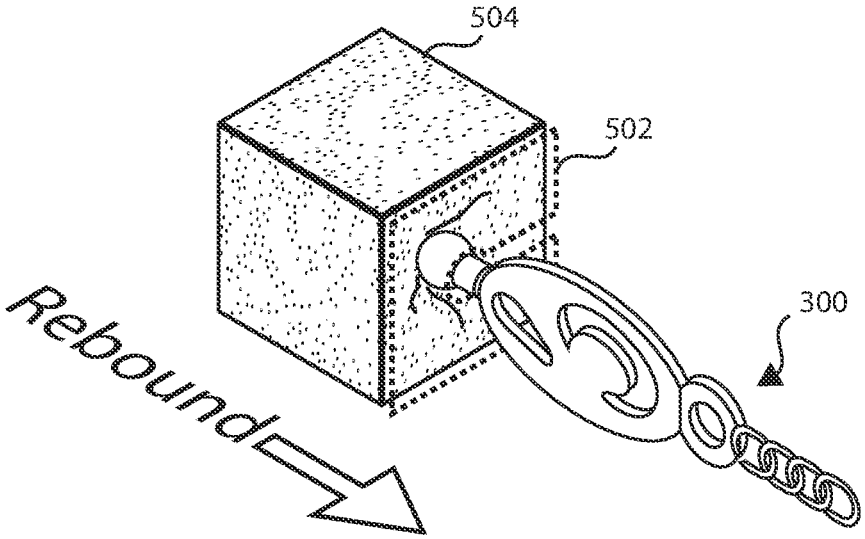
FIGS. 9A-9C illustrate example usages of a polymer according to various embodiments.
Figure 9B:
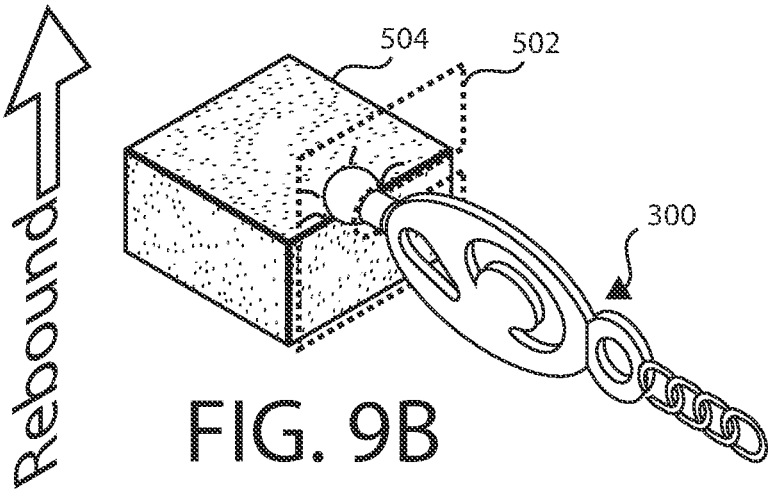
Figure 9C:
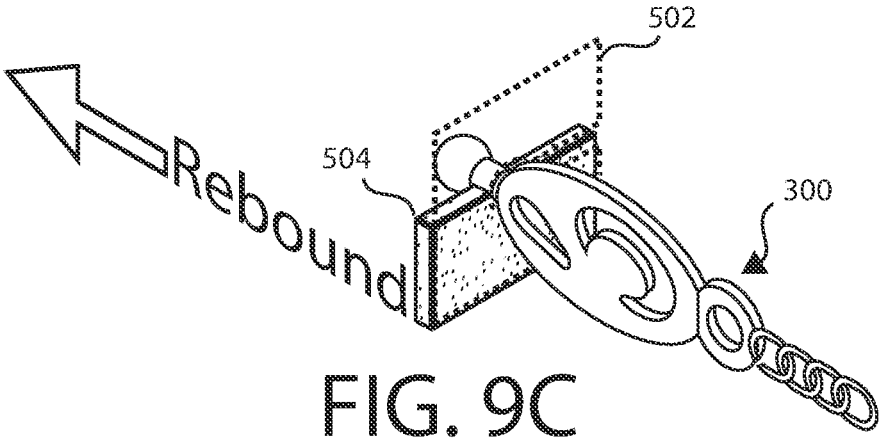

FIGS. 9A-9C show example techniques for using a compressible material 504. The techniques shown in FIGS. 9A-9C can be used in combination. Depicted in these figures is a shell 502 and compressible material 504 which can be used in combination to lock a key 300. In FIG. 9A, the compressible material 504 is configured to rebound the key 300 in a direction perpendicular to the surface of the shell 502. This configuration can be useful if the compressible material fills the interior of the shell 502 and the locking pocket 206 has an opening that is wider than the channel to receive the head 310 of the key 300 while being narrow enough to prevent extraction of the head 310.

In FIG. 9B, the compressible material 504 is configured to provide a rebounding force that is parallel to the surface of the shell 502 and perpendicular to a channel. In this configuration, the compressible material 504 can help place the key 300 in a locking pocket 206 as demonstrated in FIGS. 6C and 6D. In FIG. 9C, the compressible material 504 can provide a rebounding force that is perpendicular to a surface of the shell 502 and inward. For example, the compressible material 504 can be a thin piece applied to the interior surface of the shell 502 and can exert an inward force on the key 300. The key 300 can thus be locked in the locking pocket 206 by having the body 306 of the key at least partially enter the locking pocket 206 or by limiting the amount of compressible material 504 at the locking pocket 206. For example, the compressible material 504 can be thinner around the locking pocket 206.

Figure 10:
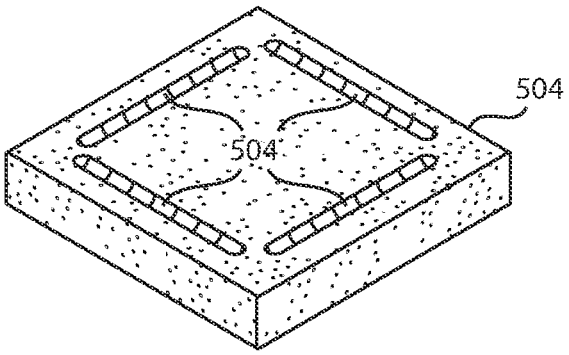
FIG. 10 illustrates example grooves in a polymer according to various embodiments.

FIG. 10 demonstrates how the compressible material 504 can have grooves 504 or other features to assist in the movement or locking of the key 300. For example, the grooves 504 can correspond to where the head 310 of the key traverses so that the compressible material 504 does not put a greater force on the head 310 of the key 300 than the neck 308 of the key 300. In some embodiments, the compressible material 504 puts little force on the head 310 of the key 300 and a greater force on the neck 308 of the key 300. This can minimize the amount of torque placed on the key 300.

Figure 11A:
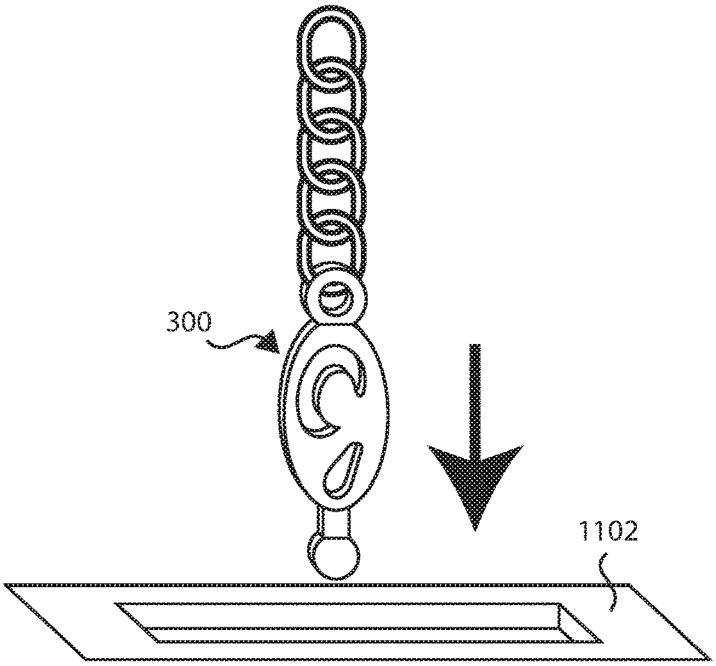
FIGS. 11A-11C show an example key locking technique according to some embodiments.
Figure 11B:
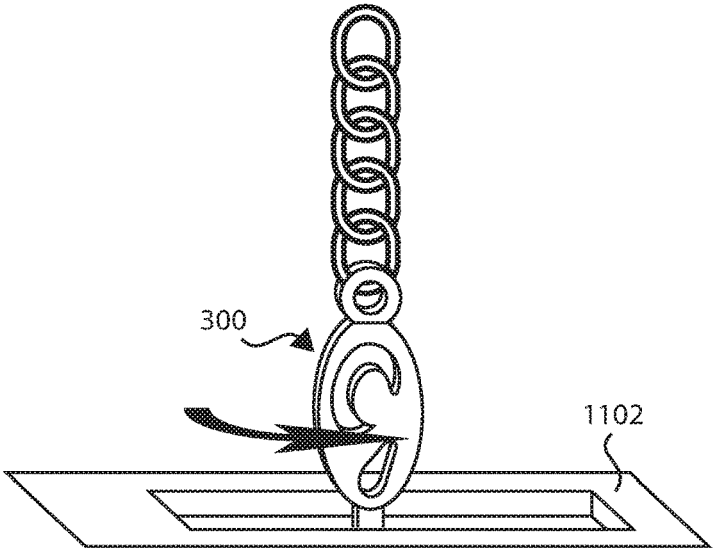
Figure 11C:
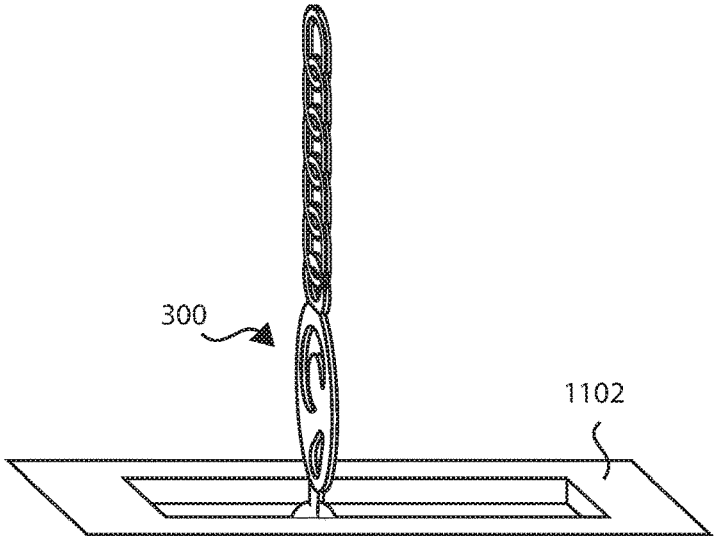

FIGS. 11A-11C show an example key locking technique according to some embodiments. For example, in addition or alternative to having specific locking pockets 206, a clasp 102 can have a channel 1102 that is similar to channel 202. The compressible material 504 in FIGS. 11A-11C can be configured similar to FIG. 11A, such that it exerts a rebounding force perpendicular to a surface of the clasp 102. Additional or alternative to an inlet port 208, a flattened key 300 can be inserted such that the flat surface of the key 300 is parallel to the opening of the channel 1102 as depicted in FIG. 11A. The key 300 can be slightly thinner than a thickness of an opening of the channel 1102.

During insertion, the key 300 can press against a compressible material 504 within the channel. Once sufficiently inserted, the key 300 can be turned as demonstrated in FIG. 11B. The neck of the key can rotate within the channel while the larger head can rotate within the channel 1102. In some embodiments, the rotational motion can cause the head of the key to, on contact with the surface of the clasp, move inwards and provide more force to the compressible material. In some embodiments, the top of the head of the key (e.g., the portion connected to the neck) can be flat so that the contact with the channel does not cause it to rotate.

Once rotated, the compressible material can press against the head of the key 300 which can then press against an interior of the opening of the channel 1102, thus keeping the key 300 from exiting the channel 1102. To keep the key 300 from rotating back accidentally, the compressible material 504 can form around the head of the key 300 and thus requiring deformation of the compressible material 504 to accommodate the turning of the key 300. Furthermore, the compressible material 504 and key can have a sufficient amount of static friction to prevent unwanted rotation.

Figure 12:
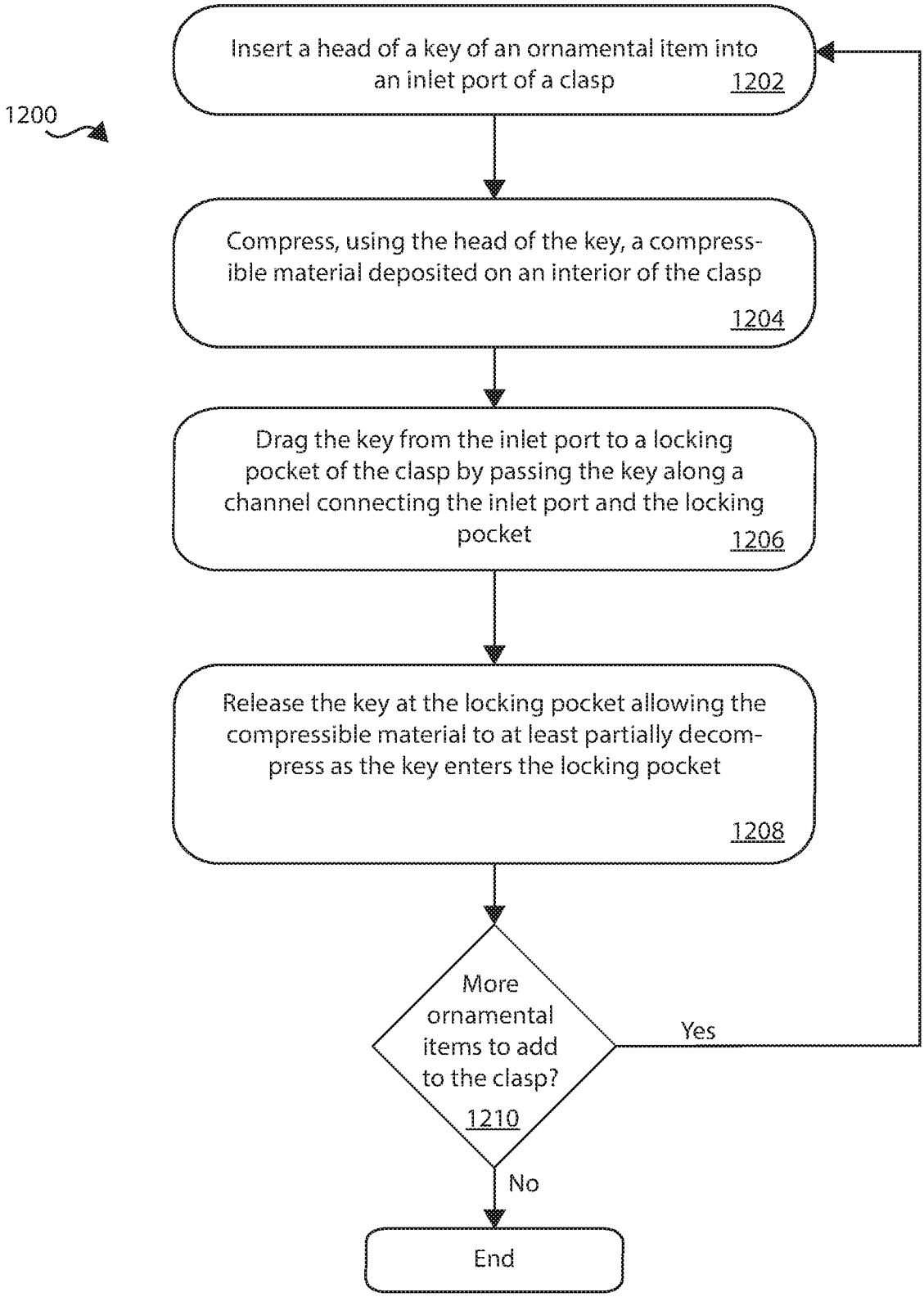
FIG. 12 illustrates an example method for connecting an ornamental item to a clasp according to some embodiments.

FIG. 12 illustrates an example method 1200 for connecting an ornamental item to a clasp according to some embodiments. A person (or device) can insert a head of a key of an ornamental item into an inlet port of a clasp 1202. For example, the person can grip the main body 306 of the key 300 and orient the key 300 such that the head 310 of the key 300 faces the clasp 102. The person can then insert the head 310 of the key into an inlet port 208 of the clasp 102. Where there are multiple inlet ports 208, the person can determine which inlet port 208 is connected, via a channel 202, to a desired locking pocket 206. In some embodiments, the inlet port 208 is positioned or defined by the intersection of two channels 202 of the clasp 102.

A person can compress, using the head of the key, a compressible material deposited on an interior of the clasp 1204. For example, the compressible material 504 can be deposited inside the clasp and can provide a rebounding force parallel to the local surface of the clasp. The combination of the rebounding force and the wall of the channel can form resistance to the key moving through the channel.

A person can drag the key from the inlet port to a locking pocket of the clasp by passing the key along a channel connecting the inlet port and the locking pocket 1206. In some embodiments, the channel 202 can be configured to hold the neck 308 of the key and prevent unwanted motion aside from movement along the path of the channel 202. For example, the opening can be narrower than a width of the head 310 of the key 300 to prevent unwanted removal at the opening. The opening can also be narrower than a width of the main body 306 of the key to prevent the key from falling into the channel.

Release the key at the locking pocket allowing the compressible material to at least partially decompress as the key enters the locking pocket 1208. In order to remove the key 300, the person can press it back to the channel thus deforming the compressible material 504 sufficiently so that the head 310 can reenter the channel 202 and be dragged towards the inlet port 208 for extraction.

A person can then determine more ornamental items to add to the clasp 1210. For example, the person may wish to attach multiple ornamental items to the clasp 102 such as chains, charms, pendants, or other items. If there are more items to add to the clasp 102, the person can return to step 1202. The person can repeat this process until all the desired items are added to the clasp 102.

The specification and drawings are illustrative rather than a restrictive sense. Various modifications and changes can be made thereunto without departing from the broader spirit and scope of the invention as set forth in the claims.

What is claimed is:

1. A jewelry assembly, comprising:

a decorative piece including a key portion having a head; and a clasp including:

an inlet port configured to receive the head of the key portion;

a channel along a surface of the clasp, the channel joining the inlet port and a locking pocket;

a front plate and a shell, wherein the shell is affixed to the front plate forming an interior of the clasp; and a compressible material positioned within the clasp configured to rebound the head of the key portion, wherein at least a portion of the channel connected to the locking pocket is positioned such that the compressible material is compressed to a first compression amount, wherein the key portion enters the locking pocket at a direction that is perpendicular relative to the compressible material and is positioned such that the material is compressed to a second compression amount, the second compression amount being less compressed than the first compression amount, the second compression amount configured to maintain the head of the key portion in the locking pocket and hinder movement of the head of the key portion back into the channel.

2. The jewelry clasp of claim 1, wherein the second compression amount is fully decompressed.

3. The jewelry clasp of claim 1, wherein the compression of the compressible material is parallel to a local surface of the clasp.

4. The jewelry clasp of claim 1, wherein the compression of the compressible material is perpendicular to a local surface of the clasp.

5. The jewelry clasp of claim 4, wherein the interior of the clasp comprises a volume between the compressible material and the inlet port, wherein the head of the key portion does not touch the compressible material upon insertion at the inlet port.

6. The jewelry clasp of claim 1, wherein the inlet port is positioned on a first side of the shell and the locking pocket is positioned on a second side of the shell, wherein the first side and the second side are not parallel.

7. The jewelry clasp of claim 1, further comprising a second locking pocket, the channel further joining the inlet port to the second locking pocket.

8. The jewelry clasp of claim 1, further comprising a second channel joining a second inlet port to a second locking pocket.

9. The jewelry clasp of claim 1, wherein the key portion comprises a main body, wherein the main body is prevented by the channel from passing into the channel.

10. The jewelry clasp of claim 1, wherein the compressible material comprises a groove parallel to the channel to at least partially accommodate the head of the key portion.

11. A jewelry assembly, comprising:

a decorative piece including a key portion having a head; and a clasp including:

an inlet port configured to receive the head of the key portion;

a channel along a surface of the clasp, the channel joining the inlet port and a locking pocket;

a front plate and a shell, wherein the shell is affixed to the front plate forming an interior of the clasp; and a compressible material positioned within the clasp opposite to the locking pocket and configured to rebound the head of the key portion, wherein at least a portion of the channel connected to the locking pocket is positioned such that the compressible material is compressed to a first compression amount, wherein when the key portion enters the locking pocket, the material is compressed to a second compression amount, the second compression amount configured to maintain the head of the key portion in the locking pocket, wherein the interior of the clasp comprises the compressible material affixed to the front plate.

12. The jewelry clasp of claim 11, wherein the compression of the compressible material is parallel to a local surface of the clasp.

13. The jewelry clasp of claim 11, wherein the compression of the compressible material is perpendicular to a local surface of the clasp.

14. The jewelry clasp of claim 13, wherein the interior of the clasp comprises a volume between the compressible material and the inlet port, wherein the head of the key portion does not touch the compressible material upon insertion at the inlet port.

15. The jewelry clasp of claim 11, wherein the inlet port is positioned on a first side of the shell and the locking pocket is positioned on a second side of the shell, wherein the first side and the second side are not parallel.

16. The jewelry clasp of claim 11, further comprising a second locking pocket, the channel further joining the inlet port to the second locking pocket.

17. The jewelry clasp of claim 11, further comprising a second channel joining a second inlet port to a second locking pocket.

18. The jewelry clasp of claim 11, wherein the compressible material comprises a groove parallel to the channel to at least partially accommodate the head of the key portion.

* * * * *